US006482243B2

(12) United States Patent
Podlipskiy

(10) Patent No.: US 6,482,243 B2
(45) Date of Patent: Nov. 19, 2002

(54) FUEL REFORMULATOR

(75) Inventor: Vladimir Y. Podlipskiy, San Diego, CA (US)

(73) Assignee: J.T. Granatelli Lubricants, Inc., Tarzana, CA (US)

( * ) Notice: Subject to any disclaimer, the term of this patent is extended or adjusted under 35 U.S.C. 154(b) by 0 days.

(21) Appl. No.: 09/815,366

(22) Filed: Mar. 22, 2001

(65) Prior Publication Data

US 2002/0134005 A1 Sep. 26, 2002

(51) Int. Cl.[7] ..... C10L 1/18; C10M 129/00; C10M 129/70

(52) U.S. Cl. ..... 44/349; 44/388; 44/389; 44/443; 508/246; 508/251; 508/261; 585/1; 585/3; 585/14

(58) Field of Search ..... 44/349, 388, 389, 44/443; 508/246, 251, 261; 585/1, 3, 14

(56) References Cited

U.S. PATENT DOCUMENTS

| | | | | | |
|---|---|---|---|---|---|
| 3,476,772 | A | * | 11/1969 | Hoyle et al. | 252/407 |
| 4,920,691 | A | | 5/1990 | Fainman | |
| 5,599,358 | A | | 2/1997 | Giavazzi | |
| 5,632,785 | A | | 5/1997 | Culotta | |
| 5,641,740 | A | * | 6/1997 | Debska-Chwaja | 508/486 |
| 5,723,138 | A | * | 3/1998 | Bae | 424/401 |
| 5,730,029 | A | | 3/1998 | Stoldt | |
| 5,888,947 | A | * | 3/1999 | Lambert et al. | 508/491 |
| 5,993,498 | A | | 11/1999 | Vrahopoulou | |
| 6,100,224 | A | | 8/2000 | Peiffer | |
| 6,193,987 | B1 | * | 2/2001 | Harbeck | 424/401 |

FOREIGN PATENT DOCUMENTS

| | | | |
|---|---|---|---|
| DE | 3426935 | * | 3/1985 |
| JP | 05230475 A2 | * | 9/1993 |

OTHER PUBLICATIONS

Author Unknown, Glossary, pp. 155–160, Energy Information Administration/Petroleum Marketing Monthly, Mar. 2001.

* cited by examiner

*Primary Examiner*—Cephia D. Toomer
(74) *Attorney, Agent, or Firm*—Nydegger & Associates

(57) ABSTRACT

The present invention is directed to a composition for use in a combustion engine either as a fuel additive or as an additive for a crankcase lubricant. The composition may include a polyunsaturated aliphatic or alicyclic compound having at least three, but no more than six, double bonds to improve the combustion process by acting as pseudo-catalyst in the combustion reaction. The composition may further include a derivative of dihydrobenzo-gamma-pyrane to improve the combustion process by acting as pseudo-catalyst in the combustion reaction. The composition may further include surfactants such as polyethylene glycol and/or one or more polyoxyalkene derivatives of either polypropylene glycol, polyethylene glycol or sorbitol. A media of fatty acid esters is provided to dilute the combustion promoters, surfactants and other ingredients allowing accurate concentrations of these ingredients to be introduced into the fuel chamber.

37 Claims, No Drawings

FUEL REFORMULATOR

FIELD OF THE INVENTION

The present invention pertains generally to an additive for fuel and oil that enhances the performance of combustion engines and reduces exhaust gas emissions. More particularly, the present invention pertains to additives that reduce both visible and invisible exhaust gas emissions, improve combustion efficiency and lubricity when introduced into the combustion chamber of an engine. The present invention is particularly, but not exclusively, useful for a performance enhancing additive that can be used in conjunction with heating fuel, jet fuel, gasoline, diesel fuel, two-cycle engine oil or four-cycle engine crankcase oil.

BACKGROUND OF THE INVENTION

Today's automotive fuels and lubricants are highly engineered to improve fuel efficiency, increase horsepower, maintain engine life and reduce environmentally hazardous emissions. For example, a typical modern fuel may contain a plurality of components designed specifically to adjust octane or cetane rating, disperse solids to prevent sludge, enhance lubricity, maintain engine cleanliness, or promote combustion.

Once an ingredient is found to be effective in one of these capacities, tests must be conducted to ensure that the ingredient does not adversely affect the performance of the other ingredients. Further, the ingredient must be tested to ensure the ingredient does not interfere with modern emission control systems such as catalytic converters, charcoal canisters and exhaust gas recirculation systems. Additionally, the ingredient must be tested to ensure that harmful emissions are not increased, including the formation of toxic emissions, greenhouse gases and smog precursors. Also, the environmental and health effects of the chemical must be considered in light of the possibility of a fuel spill.

Assuming an ingredient under consideration meets the above described operational proscriptions, mechanisms must still be provided to maintain the active ingredient in solution within the fuel, deliver the active ingredient to the combustion chamber in the proper concentration (especially when only small concentrations of the ingredient are required), and prevent the active ingredient from reaction with the other fuel components during any required storage periods. One such mechanism that can be used is to provide a media for the ingredients within the fuel. Of course the media itself then becomes an ingredient and is subject to the requirements described above concerning interaction with other ingredients, the engine and any emission control systems.

In light of the above, it is an object of the present invention to provide a composition that improves combustion efficiency and upper cylinder lubricity when introduced into the combustion chamber of an engine. Yet another object of the present invention is to provide a fuel and lubricating oil additive that increases engine life and decreases exhaust gas emissions. It is another object of the present invention to provide a composition for addition to combustible fuels and lubricants to enhance engine performance without adversely affecting the engine, the efficacy of standard fuel additives, or any applicable emission control systems. It is yet another object of the present invention to provide a performance enhancing composition having chemical constituents that remain stable after mixing with fuels and oils and during storage. Yet another object of the present invention is to provide a fuel and lubricating oil additive that improves the cetane rating of diesel fuel. It is another object of the present invention to provide a composition for addition to combustible fuels that cleans the upper cylinder and fuel injectors of a combustion engine. Another object of the present invention is to provide an additive that enhances lubricity in low sulfur diesel fuels. Still another object of the present invention is to provide a fuel and oil additive for a combustion engine that does not produce environmentally hazardous emissions during use. It is another object of the present invention to provide a composition for addition to heating oil or other open flame applications to de-soot the combustion chamber providing a cleaner burn and lower visible and invisible exhaust gas emissions. Yet another object of the present invention is to provide a fuel and oil additive which is easy to use, relatively simple to implement, and comparatively cost effective.

SUMMARY OF THE PREFERRED EMBODIMENTS

The present invention is directed to a composition for use in fuels and lubricating oils. For the present invention, the composition can be used in two-cycle, four-cycle, diesel, turbine and jet engines. As such, the composition can be added to the gasoline-oil mixture for a two-cycle, the gasoline, crankcase oil or both for a four-cycle, or the diesel fuel, crankcase oil or both for a diesel engine. Further, the composition can be added to jet fuels and fuels that are designed to produce heat.

The composition of the present invention may include a polyunsaturated aliphatic or alicyclic compounds having at least three and no more than six double bonds, wherein the bonds alternate between single bonds and double bonds along the chain. For the present invention, polyunsaturated compounds are provided to improve the combustion process by acting as a pseudo-catalyst in the combustion reaction. Vitamin A (retinol) is the preferred polyunsaturated compound for the present invention, and preferably constitutes between approximately 0.001% to approximately 0.01% of the total composition.

The composition may also include a derivative of dihydrobenzo-gamma-pyrane to improve the combustion process by acting as a pseudo-catalyst in the combustion reaction. Vitamin E (tocopherol) is the preferred derivative of dihydrobenzo-gamma-pyrane for use in the present invention and preferably constitutes between approximately 0.001% to approximately 0.01% of the total composition.

The composition may also include one or more polyoxide compounds as lubricity agents to increase engine horsepower and reduce engine wear. Preferably, the polyoxide compound used is polyethylene glycol at a concentration of between approximately 5% to approximately 15%.

The composition may also include one or more polyoxy derivatives of either polypropylene glycol, polyethylene glycol or sorbitol. For the present invention, the polyoxy derivative can be either a polyoxyalkene derivative or a polyoxyalkane derivative. Preferably, the composition is formulated with approximately 20% polyoxysorbitol alkene and approximately 15% polyoxyalkene derivatives of polypropylene glycol. For the present invention, the polyoxy alkyl derivatives are provided to function as surfactants, increase lubricity, and act as a dispersant and emulsifier to prevent phase separation within the fuel/additive mixture.

The composition may further include one or more fatty acid esters. Particularly applicable for the present invention are the mono-esters and tri-esters of fatty acids. Preferably, a mixture of fatty acid esters at a mixture concentration of between approximately 20% to approximately 60% is used in the present invention. For the present invention, the fatty acid esters are provided as a media functioning to dilute the combustion promoters, surfactants and other ingredients to allow accurate concentrations of these ingredients into the fuel chamber.

The composition may further include approximately 0.2–0.9% poly 4-T-butyl styrene. Preferably, the poly 4-T-butyl styrene has a molecular weight between approximately 20,000 and 50,000. For the present invention, the poly 4-T-butyl styrene is provided to improve combustion and reduce $NO_x$ and CO emissions.

DESCRIPTION OF THE PREFERRED EMBODIMENT

The present invention is directed to a composition for use in fuels and lubricating oils. For the present invention, the composition can be used in a two-cycle, four-cycle or diesel engine. As such, the composition can be added to the gasoline-oil mixture for a two-cycle, the gasoline, crankcase oil or both for a four-cycle, or the diesel fuel, crankcase oil or both for a diesel engine. Included in the above described engines are aviation engines which use aviation grade gasolines and lubricating oils. Further, the composition can be added to fuels designed for jet engines such as kerosene type jet fuel (including JP-5 and JP-8) and naphtha type jet fuel (including JP-4). Additionally, the composition can be added to fuels that are designed to produce heat such as kerosene, No. 2 fuel, No. 4 fuel and residual fuel oil (including No. 5 and No. 6 fuel oils). Thus, the composition can be prepared and sold as an additive to one or more of the fuels/lubricating oils described above, or the composition can be prepared and then mixed with one of the fuels/lubricating oils described above for sale as a mixture.

The composition of the present invention may include a polyunsaturated aliphatic or alicyclic compounds having at least three and no more than six double bonds, wherein the bonds alternate between single bonds and double bonds along the chain. Vitamin A (retinol) is the preferred compound for the present invention, and preferably constitutes between approximately 0.001% to approximately 0.01% of the total composition. More preferably, the vitamin A constitutes approximately 0.005% of the total composition. Compounds such as octatrieneol, decatetraeneol, octadodecopentaenol, cyclooctatrieneol, and dehydrocyclohexateraeneol may be suitable for some applications in accordance with the present invention. For the present invention, the polyunsaturated compounds (such as vitamin A) are provided to improve the combustion process by acting as pseudo-catalysts in the combustion reaction.

The composition may also include a derivative of dihydrobenzo-gamma-pyrane. Vitamin E (tocopherol) is the preferred derivative of dihydrobenzo-gamma-pyrane for use in the present invention and preferably constitutes between approximately 0.001% to approximately 0.01% of the total composition. More preferably, the vitamin E constitutes approximately 0.005 of the total composition. Compounds such as benzopyrene, benzopyrone (coumarin), coumarone (benzofuran) and benzoquinone (quinone) may be suitable for some applications in accordance with the present invention. Not unlike the vitamin A, the derivative(s) of dihydrobenzo-gamma-pyrane (which is preferably vitamin E) are provided to improve the combustion process by acting as pseudo-catalysts in the combustion reaction.

The composition may also include one or more polyoxide compounds. Preferably, the polyoxide compound used is polyethylene glycol at a concentration of between approximately 5% to approximately 15%. More preferably, the composition is prepared having approximately 5% polyethylene glycol. For the present invention, the polyoxide compounds are provided as lubricity agents to increase engine horsepower and reduce engine wear.

The composition may also include one or more polyoxy dervatives of either polypropylene glycol, polyethylene glycol or sorbitol. For the present invention, the polyoxy derivative can be either a polyoxyalkene derivative or a polyoxyalkane derivative. Preferably, the alkane/alkene has a hydrocarbon chain length of between $C_{10}$ and $C_{20}$ and is attached to the polyoxide through either an ester or an ether linkage. A suitable polyoxyalkene derivative of polypropylene glycol is sold under the trade name Pluronic-62LD. For the present invention, the composition may have between approximately 10% to approximately 50% of such polyoxy derivatives. A preferred combination of such polyoxy derivatives includes a mixture of a polyoxyalkene derivative of polypropylene glycol (such as Pluronic-61LD) and polysorbate. More preferably, the composition is formulated with approximately 20% polysorbate and approximately 15% polyoxyalkene derivatives of propylene glycol. For some applications, the composition can be formulated with between approximately 10% to approximately 50% polysorbate and between approximately 10% to approximately 50% polyoxyalkene derivatives of propylene glycol. Additionally, polyoxy derivatives with such chains as distearate, monolaurate, diacrylate, butyl ether and methacrylate may be suitable for some applications.

For the present invention, the polyoxy derivatives are provided as surfactants, which provide a variety of benefits. First, the surfactants make the fuel more hydrophilic due to the polar nature of the polyoxy derivatives. Also, as a surfactant, the polyoxy derivatives allow oxygen ($O_2$) to dissolve in the fuel easier. Further, by decreasing the surface tension of the additive, the polyoxy derivatives promote mixing between the additive and the fuel. Specifically, the polyoxide derivatives decrease surface tension, and as a result, promote the mixing of oxygen with the fuel. Additionally, the polyoxy derivatives increase lubricity, and act as a dispersant and emulsifier to prevent phase separation within the fuel/additive mixture.

The composition may further include one or more fatty acid esters. Particularly applicable for the present invention are the mono-esters and tri-esters of fatty acids. Preferably, a mixture of straight chain saturated and/or unsaturated esters and/or branched tri-esters with chain lengths of $C_{10}$–$C_{20}$ at a mixture concentration of between approximately 20% to approximately 60% is used in the present invention. For some applications, the esters ethyl stearate, ethyl levulinate, ethyl linoleate, ethyl isovaleriate and methyl stearate may be applicable.

For the present invention, the fatty acid esters are provided as a media functioning to dilute the combustion promoters, surfactants and other ingredients to allow accurate concentrations of these ingredients into the fuel chamber. Also, the media of fatty acid esters helps to keep the combustion promoters, surfactants and other ingredients emulsified in the media, lowering the interaction of these ingredients with components of the fuel that may react with the ingredients during storage. Some of the esters, such as poly[di(ethylene glycol)/trimethylolpropane-alt-adipic acid], polyols can also function as a heat resistant agent, having a high specific heat capacity, to prevent damage to other components due to high temperatures. Also, this ester contributes toward decreasing $NO_x$ exhaust emissions. For some applications, an optional quantity of mineral oil may be included in the composition to supplement the media.

The composition may further include approximately 0.2–0.9% poly 4-T-butyl styrene. Preferably, the poly 4-T-butyl styrene has a molecular weight between approximately 20,000 and 50,000. For the present invention, the poly 4-T-butyl styrene is provided to improve combustion and reduce $NO_x$ and CO emissions.

To prepare the composition, first the polyoxy alkyl derivatives and polyoxide compounds are mixed together. Next, the esters are combined into the mixture of polyoxy alkyl derivatives and polyoxide compounds until a uniform consistency is obtained. Finally, the combustion promoters such as vitamins A and E are added to the mix and combined using moderate stirring until a uniform consistency is obtained. When the above procedure is performed at room temperature, 2–3 hours is generally required to perform the mix and prepare the product. To decrease the mix time, the composition can be prepared at a temperature of approximately 80–100 degrees C., in which case the composition can be prepared in approximately 30–40 minutes.

Once prepared, the composition can be added to the fuel/lubricating oil for use. When the composition is used with gasoline (for a four-cycle engine) or diesel fuel, an exemplary mix ratio of 1 part composition to approximately 500–1500 parts fuel is contemplated for the present invention. When the composition is used for a two-cycle engine, an exemplary mix ratio of 1 part composition to 1–5 parts lubricating oil is first prepared and the composition/lubricating oil mixture is added to the fuel at a mix ratio of 1 part composition/lubricating oil to approximately 16–100 parts gasoline. When the composition is used in turbine/jet engines, an exemplary mix ratio of 1 part composition to approximately 500–1500 parts jet fuel is contemplated for the present invention. When the composition is used in conjunction with heating oil, an exemplary mix ratio of 1 part composition to approximately 500–1500 parts heating oil is contemplated for the present invention. When the composition is used in conjunction with a crankcase oil, an exemplary mix ratio of 1 part composition to approximately 12–20 parts crankcase oil is contemplated for the present invention.

While the particular composition as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A composition for use in a combustion engine, said composition comprising a crankcase oil; a polyunsaturated aliphatic or alicyclic compound, said compound having at least three and no more than six double bonds; and a derivative of dihydrobenzo-gamma-pyrane.

2. A composition as recited in claim 1 further comprising a polyoxide derivative of a compound selected from the group consisting of polypropylene glycol, polyethylene glycol and sorbitol.

3. A composition as recited in claim 1 further comprising:

an ester of a fatty acid.

4. A composition as recited in claim 1 further comprising:

polypropylene glycol.

5. A composition as recited in claim 1 wherein said polyunsaturated aliphatic or alicyclic compound comprises vitamin A.

6. A composition as recited in claim 1 wherein said derivative of dihydrobenzo-gamma-pyrane comprises vitamin E.

7. A composition for use in a combustion engine, said composition comprising a two-cycle lubricating oil; a polyunsaturated aliphatic or alicyclic compound, said compound having at least three and no more than six double bonds; and a derivative of dihydrobenzo-gamma-pyrane.

8. A composition as recited in claim 7 further comprising a polyoxide derivative of a compound selected from the group consisting of polypropylene glycol, polyethylene glycol and sorbitol.

9. A composition as recited in claim 7 further comprising:

an ester of a fatty acid.

10. A composition as recited in claim 7 further comprising:

polypropylene glycol.

11. A composition as recited in claim 7 wherein said polyunsaturated aliphatic or alicyclic compound comprises vitamin A.

12. A composition as recited in claim 7 wherein said derivative of dihydrobenzo-gamma-pyrane comprises vitamin E.

13. A composition for use in a combustion engine, said composition comprising a gasoline; a polyunsaturated aliphatic or alicyclic compound, said compound having at least three and no more than six double bonds; and a derivative of dihydrobenzo-gamma-pyrane.

14. A composition as recited in claim 13 further comprising a polyoxide derivative of a compound selected from the group consisting of polypropylene glycol, polyethylene glycol and sorbitol.

15. A composition as recited in claim 13 further comprising:

an ester of a fatty acid.

16. A composition as recited in claim 13 further comprising:

polypropylene glycol.

17. A composition as recited in claim 13 wherein said polyunsaturated aliphatic or alicyclic compound comprises vitamin A.

18. A composition as recited in claim 13 wherein said derivative of dihydrobenzo-gamma-pyrane comprises Vitamin E.

19. A composition for use in an engine, said composition comprising a jet fuel and a catalyst selected from the group-consisting of a polyunsaturated aliphatic or alicyclic compound, said compound having at least three and no more than six double bonds and a derivative of dihydrobenzo-gamma-pyrane.

20. A composition as recited in claim 19 further comprising a polyoxide derivative of a compound selected from the group consisting of polypropylene glycol, polyethylene glycol and sorbitol.

21. A composition as recited in claim 19 further comprising:

an ester of a fatty acid.

22. A composition as recited in claim 19 further comprising:

polypropylene glycol.

23. A composition as recited in claim 19 wherein said polyunsaturated aliphatic or alicyclic compound comprises vitamin A.

24. A composition as recited in claim 19 wherein said derivative of dihydrobenzo-gamma-pyrane comprises vitamin E.

25. A composition for use in a combustion engine, said composition comprising a diesel fuel and a catalyst selected from the group consisting of a polyunsaturated aliphatic or alicyclic compound, said compound having at least three and no more than six double bonds and a derivative of dihydrobenzo-gamma-pyrane.

26. A composition as recited in claim 25 further comprising a polyoxide derivative of a compound selected from the group consisting of polypropylene glycol, polyethylene glycol and sorbitol.

27. A composition as recited in claim 25 further comprising:

an ester of a fatty acid.

28. A composition as recited in claim 25 further comprising:

polypropylene glycol.

29. A composition as recited in claim 25 wherein said polyunsaturated aliphatic or alicyclic compound comprises vitamin A.

30. A composition as recited in claim 25 wherein said derivative of dihydrobenzo-gamma-pyrane comprises vitamin E.

31. A composition as recited in claim 25 wherein said diesel fuel is a low sulfur diesel fuel.

32. A composition for use in a heater, said composition comprising a heating oil and a catalyst selected from the group consisting of a polyunsaturated aliphatic or alicyclic compound, said compound having at least three and no more than six double bonds and a derivative of dihydrobenzo-gamma-pyrane.

33. A composition as recited in claim 32 further comprising a polyoxide derivative of a compound selected from the group consisting of polypropylene glycol, polyethylene glycol and sorbitol.

34. A composition as recited in claim 32 further comprising:

an ester of a fatty acid.

35. A composition as recited in claim 32 further comprising:

polypropylene glycol.

36. A composition as recited in claim 32 wherein said polysaturated aliphatic or alicyclic compound comprises vitamin A.

37. A composition as recited in claim 32 wherein said derivative of dihydrobenzo-gamma-pyrane comprises vitamin E.

* * * * *

UNITED STATES PATENT AND TRADEMARK OFFICE

CERTIFICATE OF CORRECTION

PATENT NO. : 6,482,243 B2
DATED : November 19, 2002
INVENTOR(S) : Vladimir Y. Podlipskiy It is certified that error appears in the above-identified patent and that said Letters Patent is hereby corrected as shown below:

Column 4,
Line 15, delete “Pluronic-62LD.” insert -- Pluronic-61LD. --

Column 5,
Line 20, delete “C.,” insert -- C, --

Column 6,
Line 47, delete “group-consisting” insert -- group consisting --

Signed and Sealed this

Twenty-fifth Day of February, 2003

JAMES E. ROGAN
*Director of the United States Patent and Trademark Office*